US007793360B2

(12) United States Patent
Blauer et al.

(10) Patent No.: US 7,793,360 B2
(45) Date of Patent: Sep. 14, 2010

(54) HIGH-VISIBILITY TURNOUT COAT ASSEMBLAGE

(75) Inventors: Stephen J Blauer, Lexington, MA (US); Thomas W Ames, Brookline, MA (US)

(73) Assignee: Blauer Manufacturing Company, Inc., Boston, MA (US)

( * ) Notice: Subject to any disclaimer, the term of this patent is extended or adjusted under 35 U.S.C. 154(b) by 187 days.

(21) Appl. No.: 12/128,702

(22) Filed: May 29, 2008

(65) Prior Publication Data

US 2010/0186136 A1 Jul. 29, 2010

(51) Int. Cl.
*A62B 17/00* (2006.01)

(52) U.S. Cl. ..... 2/81; 2/94; 2/95; 2/96; 2/97; 2/102; 2/462; 2/46; 2/48

(58) Field of Classification Search ..... 2/81, 2/94, 95, 96, 97, 102, 462, 46, 48, 49.1
See application file for complete search history.

(56) References Cited

U.S. PATENT DOCUMENTS 3,034,133 A * 5/1962 Eilenberg ..... 2/97
4,320,538 A * 3/1982 Saft ..... 2/102
4,754,500 A * 7/1988 Brucato et al. ..... 2/105
5,110,655 A 5/1992 Engler et al.
5,188,267 A 2/1993 Sargent et al.
D440,716 S 4/2001 Lesley
6,820,280 B1 11/2004 Atallah et al.
6,892,394 B2 5/2005 Grilliot et al.
6,978,481 B2 * 12/2005 Mordecai et al. ..... 2/81

* cited by examiner

*Primary Examiner*—Gary L Welch
*Assistant Examiner*—Alissa J Tompkins
(74) *Attorney, Agent, or Firm*—Altman & Martin; Steven K. Martin

(57) ABSTRACT

A high-visibility covering is removably attached to a firefighter turnout coat at the shoulders and front closure by easily separable fasteners so that the assemblage can be donned as a single coat and the high-visibility covering can be easily ripped off. In one embodiment, the covering is a single panel that wraps around the coat, extending from the shoulders to the waist or hips. In another embodiment, the covering is composed of three panels, two front panels and a back panel. Front shoulder straps on the covering are removably attached to the front of the turnout coat at the shoulders. Back shoulder straps on the panel overlap and are removably attached to the corresponding front shoulder straps. In the three panel embodiment, the back panel has a pair of lappets that overlap and are removably attached to the corresponding front panel.

7 Claims, 5 Drawing Sheets

HIGH-VISIBILITY TURNOUT COAT ASSEMBLAGE

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to protective clothing, and, more particularly, to the high-visibility requirement of firefighter turnout coats.

2. Description of the Related Art

American National Standards Institute (ANSI) standard 107-2004 provides guidelines for high-visibility safety apparel to improve worker visibility during the day, in low-light conditions, and at night. In 2006, ANSI approved and published a new standard, ANSI 207-2006, for visibility requirements for safety vests worn by public safety personnel such as firefighters. The standard specifies minimum performance and design requirements for safety vests to insure appropriate visibility to moving vehicles while simultaneously minimizing interference with equipment worn by the person. The safety vests are to be worn only around traffic and, in accordance with National Fire Protection Association (NFPA) 1971-2000 (Standard on Protective Ensemble for Structural Firefighting) must be removed before approaching a fire. One way for firefighters to meet the visibility requirements is to wear a high-visibility vest over the turnout coat that can be easily removed prior to approaching a fire. One such vest is disclosed in U.S. Pat. No. 6,820,280, entitled RIP-OFF, HIGH-VISIBILITY, SAFETY VEST. The vest has hook and loop fasteners, such as VELCRO, at the waist or hips and shoulders so that the vest can be easily pulled away when necessary. The main drawback to this arrangement is that it employs another garment that must be donned after the turnout coat, taking extra time, a luxury that firefighters do not always have.

BRIEF SUMMARY OF THE INVENTION

An object of the present invention is to provide a clothing assemblage that permits firefighters to easily and conveniently meet both the visibility requirements of ANSI 207-2006 and the protection requirements of NFPA 1971-2000.

In the present invention, a high-visibility covering is removably attached to a firefighter turnout coat at the shoulders and front closure by easily separable fasteners. The assemblage is donned as a single coat and the high-visibility covering can be easily ripped off.

The covering has two embodiments. In the first, the covering is a single panel that wraps around the coat, extending from the shoulders to the waist or hips. In the second, the covering is composed of three panels: a right front panel, a left front panel, and a back panel. Front shoulder straps on the covering are removably attached to the front of the turnout coat at the shoulders by easily separable fasteners. Back shoulder straps on the panel overlap and are removably attached to the corresponding front shoulder straps by easily separable fasteners. In the three panel embodiment, the back panel has a pair of lappets that overlap and are removably attached to the corresponding front panel by easily separable fasteners.

The covering panel(s) is a polymeric fabric that is finished with a high chromaticity fluorescent dye in a highly luminescent color.

Several embodiments are contemplated for the covering closure. The coat closure has a fastener, typically a zipper, and a vertical flap the covers the fastener. In one embodiment, the front edges of the covering are removably attached to the front of the coat adjacent to the flap by easily separable fasteners. In another embodiment, one front edge of the covering is removably attached adjacent to the flap and the other front edge is removably attached to the flap. In a third embodiment, one front edge of the covering is removably attached adjacent to the flap and the other front edge overlaps the flap and is removably attached to the first front edge.

Retroreflective bands span the covering in any pattern that that meets the requirements of ANSI 207-2006. Optional trim at the edge of the bands provides a distinctive and sharp border.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
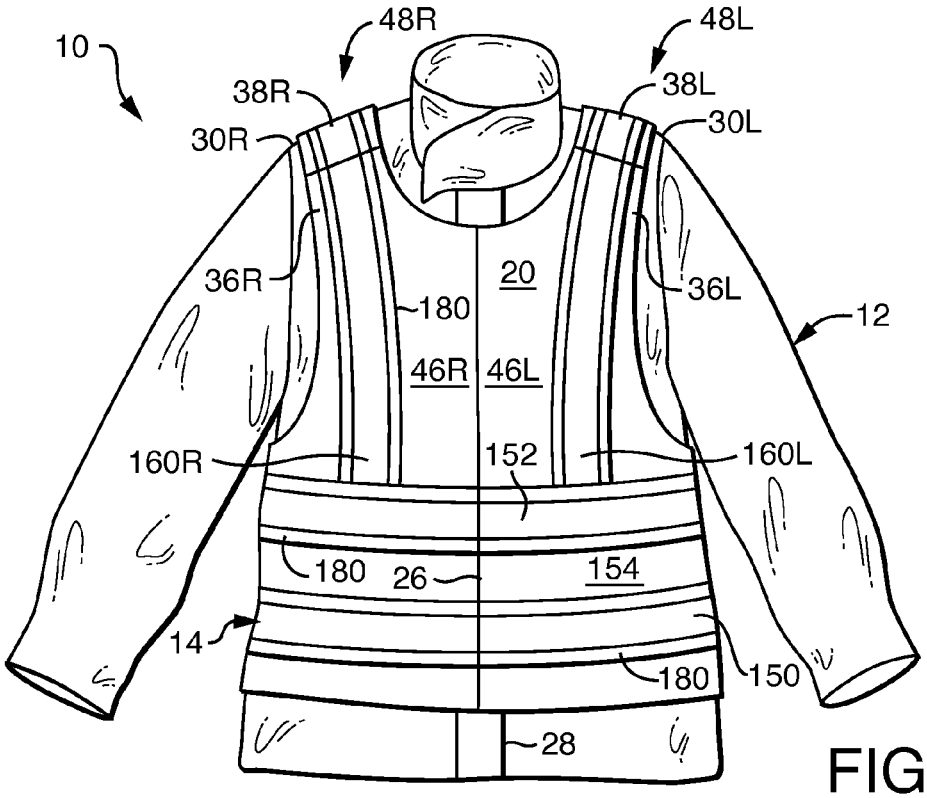
FIG. 1 is a front view of the assemblage of the present invention with the single-panel embodiment of the covering.

The present invention incorporates a firefighter turnout coat 12 and a high-visibility covering 14 in an assemblage 10. The covering 14 is removably attached to the turnout coat 12 by easily separably fasteners. The coat/covering assemblage is donned as a single coat, rather than as a coat and then a high-visibility vest, saving time. When the high-visibility covering is no longer needed, such as when approaching a fire, it can be easily ripped off.

The preferred fasteners are hook and loop fasteners, for example, those sold under the trade name VELCRO. Hook and loop fasteners come in two mating elements as fabric patches. The patches can be attached to the coat and panel fabric in whatever way is appropriate, and can include sewing and adhesives. Attachments to the turnout coat 12 cannot impair the protective requirements of the coat as mandated by NFPA 1971. Although hook and loop fasteners are preferred and are employed exclusively in the remainder of the present specification, the present invention contemplates the use of other easily separable fasteners, such as snaps, tacky patches, and magnetic patches.

A turnout coat 12 is the type of jacket worn by firefighters. According to the National Fire Protection Association (NFPA) 1971 (Standard on Protective Ensemble for Structural Firefighting), a turnout coat must be comprised of three components: an outer shell, a moisture barrier, and a thermal barrier, with pockets of air therebetween. The materials used for the three layers may vary but will very often include a NOMEX/KEVLAR combination of material.

The present invention envisions two embodiments of the covering 14. In the first embodiment 16, shown in FIGS. 1-3, the covering 14 is composed of a single panel 20 with a right front portion 46R, a left front portion 46L, and a back portion 34. The single panel 20 wraps around the coat 12, extending from the shoulders 30R, 30L (collectively, 30) to the waist or hips (referred to collectively as the hips in the remainder of the specification and claims 32R, 32L (collectively, 32). The panel 20 attaches to the coat 12 at the shoulders 30 and at the front closure 28 of the coat 12.

Preferably, the panel 20 is composed of tightly knit or woven strands of polyester or polypropylene, and are characterized by a denier ranging from 30 to 500 and a weight ranging from 2 to 6 ounces per square yard. This polymeric fabric is finished with a high chromaticity fluorescent dye in a highly luminescent color, such as yellow, green, orange or white, that collects light, which may be of relatively low luminosity, e.g. ambient light, and responds by emitting light of relatively high luminosity.

Front shoulder straps 36R, 36L (collectively, 36) extend upwardly from the right front portion 46R and left front portion 46L, respectively, of the panel 20 and are removably attached to the front of the turnout coat 12 by easily separable fasteners 40R, 40L (collectively, 40). One element 42R, 42L (collectively, 42) of each fastener 40 is attached to the front of the coat 12 at the shoulders 30 and the other element 44R, 44L (collectively, 44) of the fastener 40 is attached to the inside of the corresponding front shoulder strap 36.

Back shoulder straps 38R, 38L (collectively, 38) extending upwardly from the back portion 34. Each back shoulder strap 38 overlaps the corresponding front shoulder strap 36 and is removably attached to the corresponding front shoulder strap 36 by an easily separable fastener 48R, 48L (collectively, 48). One element 50R, 50L (collectively, 50) of the fastener 48 is attached to the outside of the covering front shoulder strap 36 and the other element 52R, 52L (collectively, 52) is attached to the inside of the covering back shoulder strap 38.

For all attachments between the covering 14 and the coat 12, in order to avoid problems with undesirable objects adhering to the turnout coat 12, it is preferred that the fastener element 42 on the coat 12 be the loop component because of the hook component's tendency to adhere to most fuzzy surfaces that come into contact with it.

In a similar vein, it is desirable that both fasteners element 44, 50 on the front shoulder strap 36 be same fastener component, be it the hook component or the loop component, so that when the covering 14 is removed, the fastener element 52 on back shoulder strap 38 will not inadvertently adhere to the fastener element 42 on the front of the coat 12.

Figure 4:
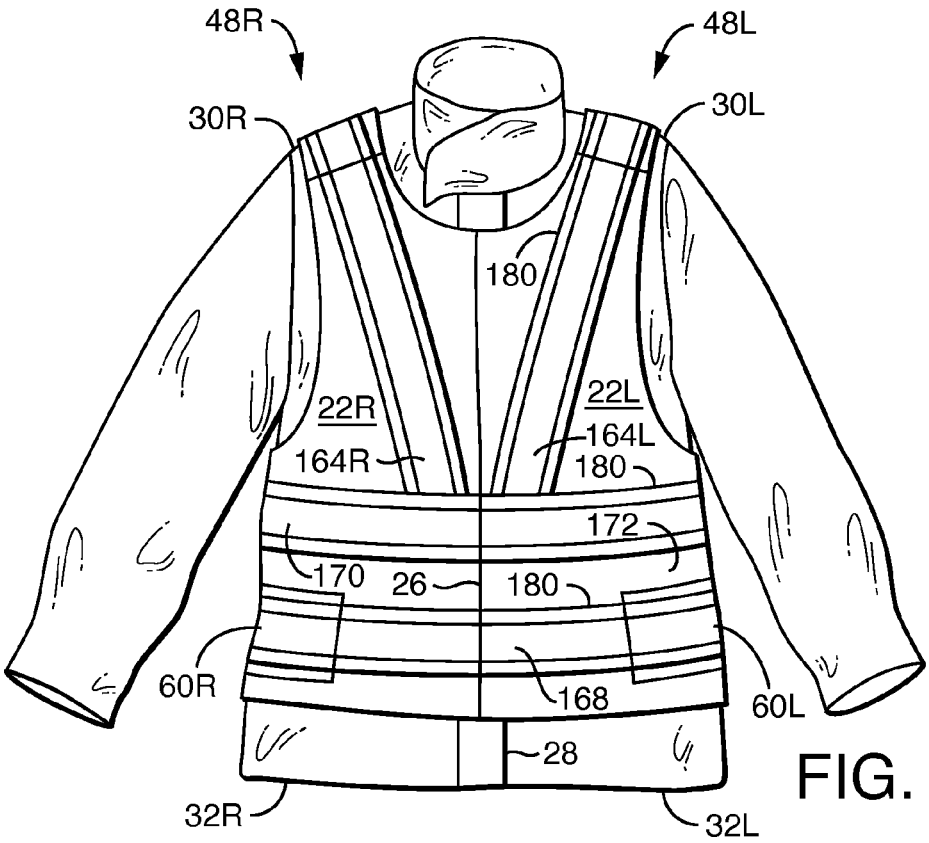
FIG. 4 is a front view of the assemblage of the present invention with the three-panel embodiment of the covering.
Figure 5:
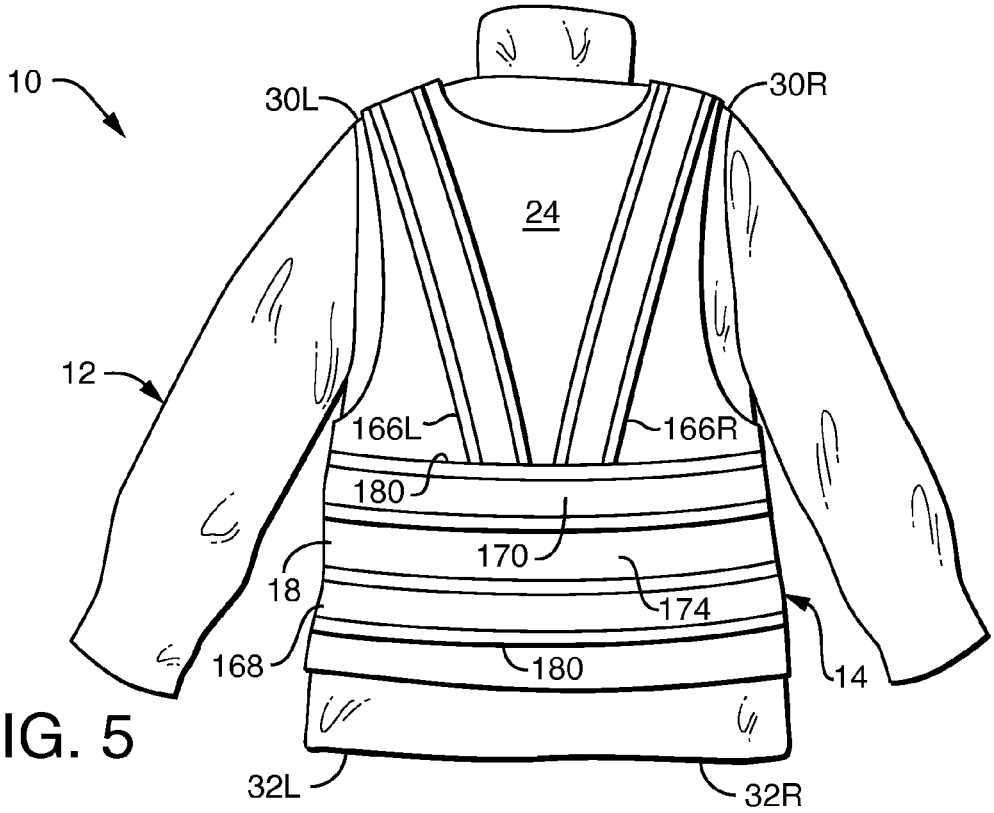
FIG. 5 is a back view of the three-panel embodiment of FIG. 4.
Figure 6:
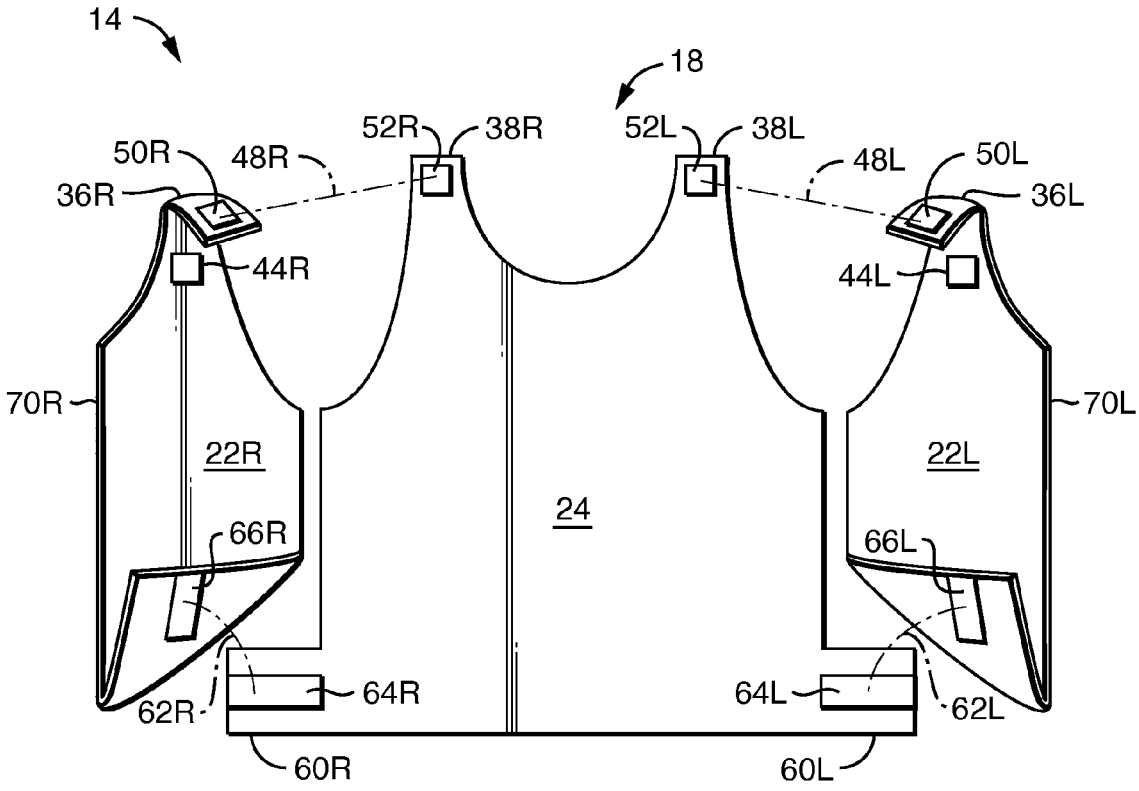
FIG. 6 is an exploded view of the three-panel embodiment of FIG. 4 without the turnout coat.

The second embodiment 18 of the covering 14, shown in FIGS. 4-6, is composed of three panels, a right front panel 22R, a left front panel 22L (collectively, 22), and a back panel 24. The right front panel 22R extends from the right shoulder 30R to the right hip 32R, the left front panel 22L extends from the left shoulder 30L to the left hip 32L, and the back panel 24 extends from the shoulders 30 to the hips 32. The shoulder attachments 40 and the shoulder strap attachments 48 are the same as those of the single-panel embodiment 16.

The back panel 24 has a pair of lappets 60R, 60L (collectively, 60) that overlap with the front panels 22 and are removably attached together by easily separable fasteners 62R, 62L (collectively, 82). One element 64R, 64L (collectively, 64) of the fastener 62 is attached to the inside of the lappet 60 and the other element 66R, 66L (collectively, 66) of the fastener 62 is attached to the outside of the corresponding front panel 22.

FIGS. 3 and 6-9 show several embodiments of the covering closure 26 for both the single-panel embodiment 16 and the three-panel embodiment 18. The covering closure 26 of FIGS. 3 and 7 can be used if the turnout coat closure 28 has a vertical retroreflective strip 88 and the covering closures 26 of FIGS. 8 and 9 can be used for all turnout coats 12. The coat closure 28 has a fastener 82 to fasten the two sides 80R, 80L of the coat together. A vertical flap 84 goes over the fastener 82 and the flap 84 is held in place by a removable fastener 86 to provide additional protection.

Figure 3:
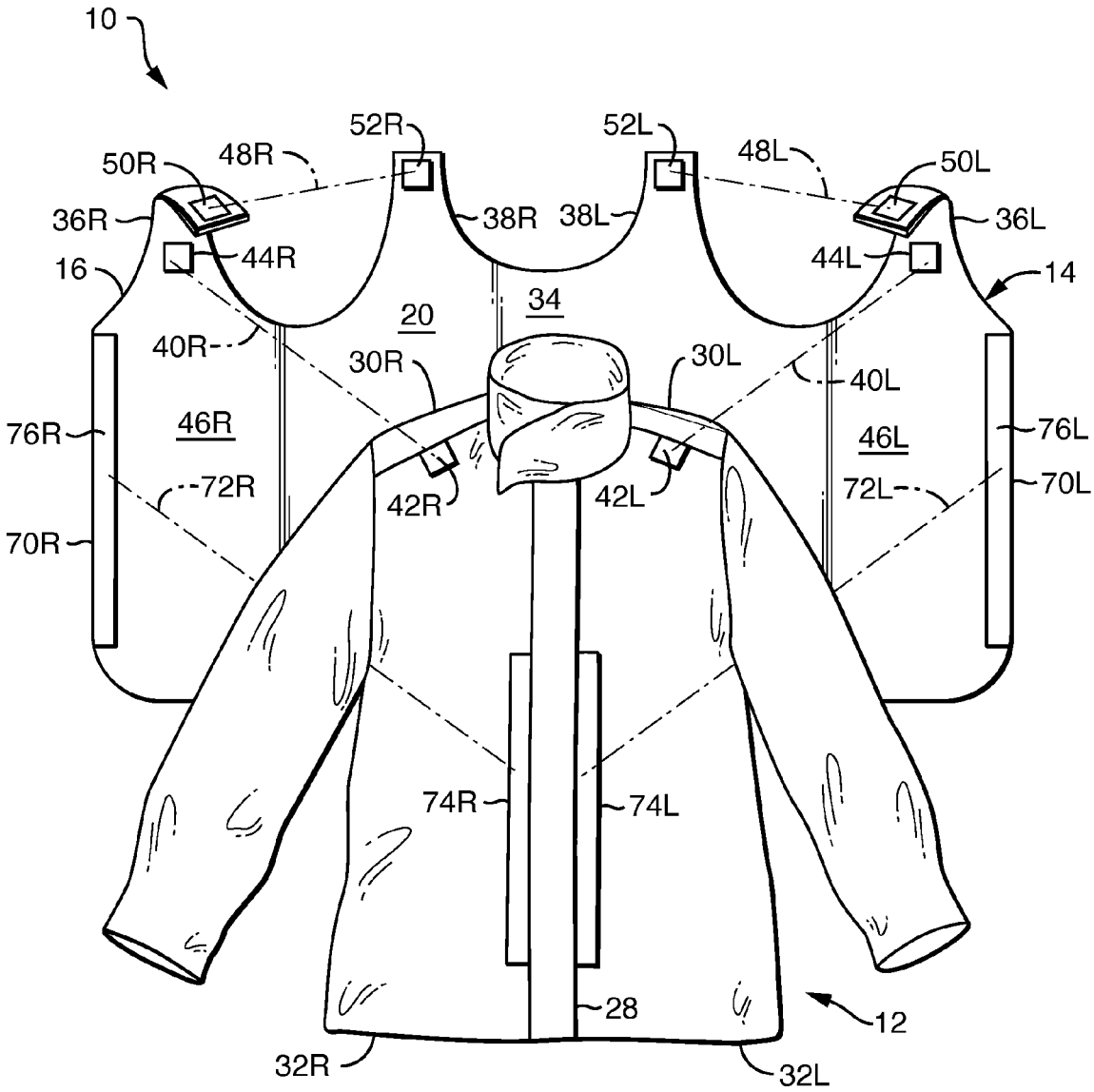
FIG. 3 is an exploded view of the single-panel embodiment of FIG. 1.
Figure 7:
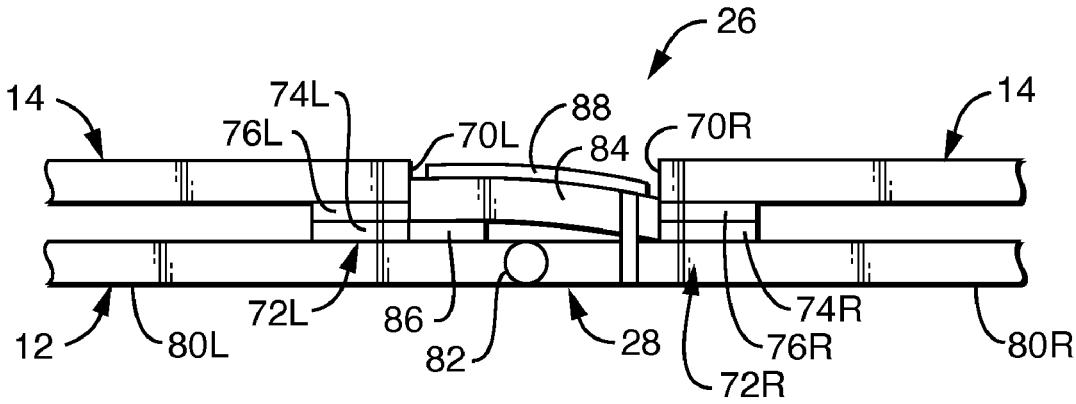
FIG. 7 is an exaggerated, top, cross-sectional view of one configuration of the center front of the assemblage.

In the closure 26 of FIGS. 3 and 7, the front edges 70R, 70L (collectively, 70) of the covering 14 are removably attached to the front of the coat 12 at the coat closure 28 adjacent to the flap 84 by two easily separable fasteners 72R, 72L (collectively, 72). One element 74R, 74L (collectively, 74) of the fastener 72 is attached to the front of the coat 12 adjacent to the flap 84 and the other element 76R, 76L (collectively, 76) of the fastener 72 is attached to the inside of the covering front edge 70.

Figure 8:
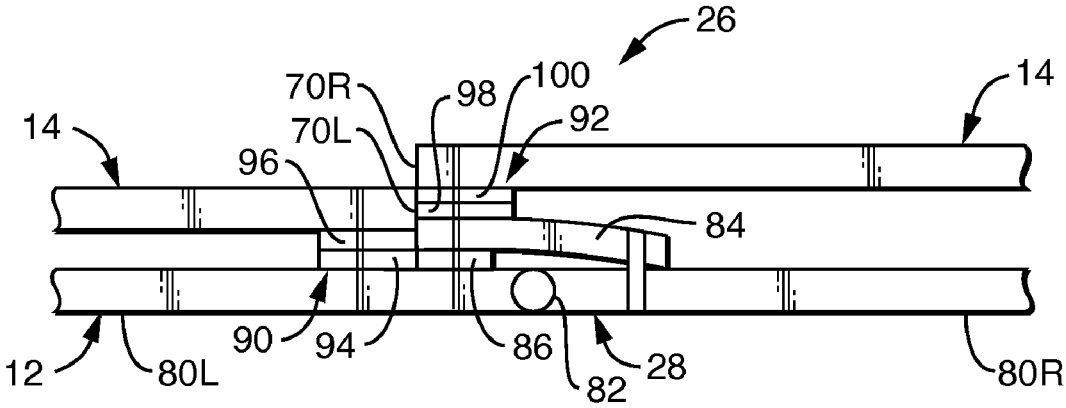
FIG. 8 is an exaggerated, top, cross-sectional view of another configuration of the center front of the assemblage.

In the closure 26 of FIG. 8, the front edges 70 of the covering 14 are removably attached to the front of the coat 12 at the coat closure 28 by two easily separable fasteners 90, 92. One element 94 of fastener 90 is attached to the front of the coat 12 adjacent to the flap 84 and the other element 96 of fastener 90 is attached to the inside of the covering left front edge 70L. One element 98 of fastener 92 is attached to the front of the coat 12 on top and at the edge of the flap 84 and the other element 100 of fastener 92 is attached to the inside of the covering right front edge 70R. When the flap 84 is closed, the front edges 70 abut each other, giving the appearance of continuity.

Figure 9:
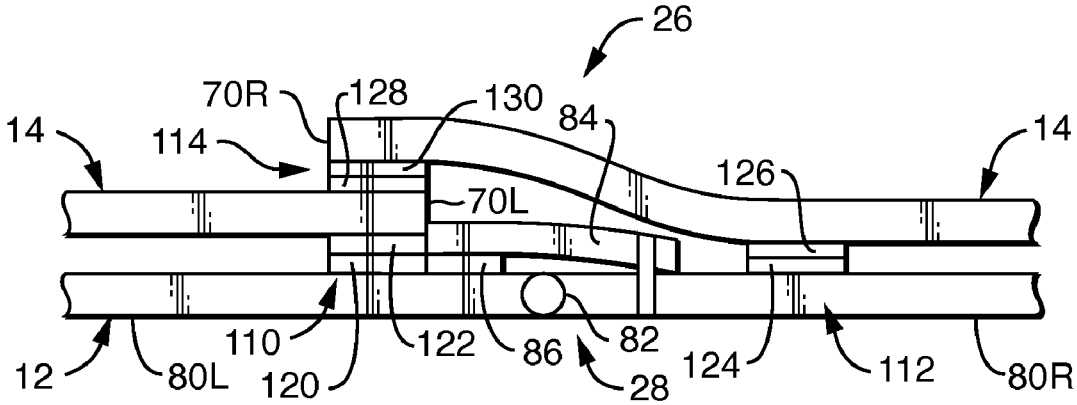
FIG. 9 is an exaggerated, top, cross-sectional view of another configuration of the center front of the assemblage.

In the closure 26 of FIG. 9, the front edges 70 of the covering 14 are removably attached to the front of the coat 12 by three easily separable fasteners 110, 112, 114. One element 120 of the fastener 110 is attached to the front of the coat 12 adjacent to the flap 84 and the other element 122 of the fastener 110 is attached to the inside of the covering left front edge 70L. One element 124 of the fastener 112 is attached to the front of the coat 12 adjacent to the flap 84 and the other element 126 of the fastener 112 is attached to the inside of the covering spaced from the right front edge 70R. One element 128 of the fastener 114 is attached to the outside of the covering left front edge 70L and the other element 130 of the fastener 114 is attached to the inside of the covering right front edge 70R. When the flap 84 and panel 20 are closed, the front edges 70 overlap each other, giving the appearance of continuity.

All embodiments of the covering fasteners 72, 90, 92, 110, 112, 114 may extend continuously over the length of closure, as in FIG. 3, or some shorter length. Alternatively, the covering fasteners 72, 90, 92, 110, 112, 114 may be composed of short patches of fastener elements along the length of the closure.

Retroreflective bands span the covering 14. As is well known, retroreflective surfaces (i.e. distributions of minute corner reflectors or high refractive index glass beads) return specular light in the direction of its source, e.g. vehicle headlights at night. An example of a retroreflective band contemplated for use in the present invention is sold by 3M Company under the trade name SCOTCHLITE.

The present invention contemplates any pattern of retroreflective bands that are adequate to meet the requirements of ANSI 207-2006, which requires at least 201 square inches of retroreflective material. Two different patterns are shown in the figures.

Figure 2:
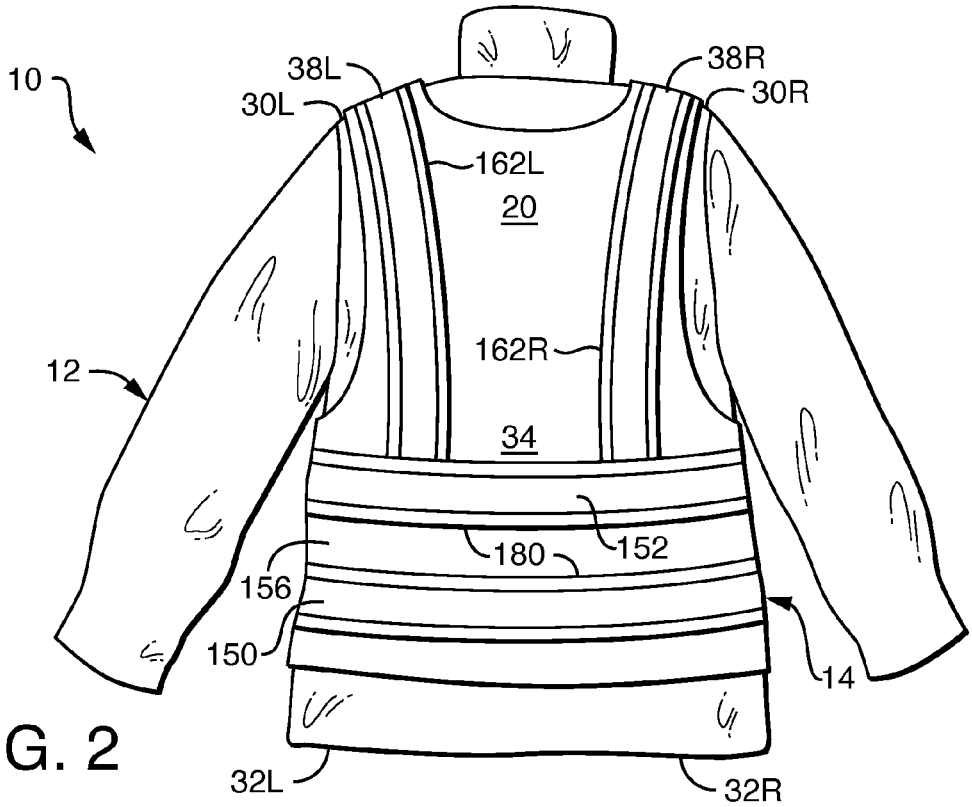
FIG. 2 is a back view of the single-panel embodiment of FIG. 1.

As shown in FIGS. 1 and 2, a lower horizontal retroreflective band 150 extends around the covering 14 near the bottom and when the covering closure 26 is closed, appear as a continuous band around the torso. An upper horizontal band 152 extends around the covering 14 near the center under the arms and when the covering closure 26 is closed, appear as a continuous band around the torso. The horizontal bands 150, 152 define regions 154, 156 therebetween for the optional presentation of alphanumeric or other graphic indicia.

A pair of vertical retroreflective bands 160R, 160L extend upwardly from the upper band 152 in the front to the shoulders 30 and a pair of vertical retroreflective bands 162R, 162L extend upwardly from the upper band 152 in the back to the shoulders 30. The vertical bands 160R, 160L, 162R, 162L overlap with the shoulder strap attachments 40 to form bands that appear continuous around the shoulders 30.

Another pattern is shown in FIGS. 4 and 5. A lower horizontal retroreflective band 168 extends around the covering 14 near the bottom and when the covering closure 26 and the lappets 60 are closed, appear as a continuous band around the torso. An upper horizontal band 170 extends around the covering 14 near the center under the arms and when the covering closure 26 is closed, appear as a continuous band around the torso. The horizontal bands 168, 170 define regions 172, 174 therebetween for the optional presentation of alphanumeric or other graphic indicia.

A pair of slanted vertical retroreflective bands 164R, 164L extend upwardly and outwardly from the center of the upper band 170 in the front to the shoulders 30 and a pair of vertical retroreflective bands 166R, 166L extend upwardly and outwardly from the center of the upper band 152 in the back to the shoulders 30. The vertical bands 164R, 164L, 166R, 166L overlap with the shoulder strap attachments 40 to form bands that appear continuous around the shoulders 30.

The covering 14, when normally viewed, is generally of a highly luminescent color. The retroreflective bands, when normally viewed, are generally dull gray. Optional trim 180 at the edge of the bands provides a distinctive and sharp border.

Thus it has been shown and described a high-visibility turnout coat assemblage which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

What is claimed is:

1. A high-visibility turnout coat assemblage comprising:

(a) a turnout coat having a front closure, a right shoulder having a right easily separable fastener, and a left shoulder having a left easily separable fastener;

(b) a covering extending around said coat and from shoulders to hips, said covering having a right front portion, a left front portion, and a back portion, said covering being composed of a luminescent material;

(c) said right front portion being removably attached to said turnout coat at said right shoulder by said right easily separable fastener;

(d) said left front portion being removably attached to said turnout coat at said left shoulder by said left easily separable fastener;

(e) said back portion having a right strap removably attached to said right front portion by an easily separable fastener and a left strap removably attached to said left front portion by an easily separable fastener;

(f) said right front portion and said left front portion being removably attached to said turnout coat at said front closure by easily separable fasteners; and (g) retroreflective bands spanning said covering.

2. The assemblage of claim 1 wherein said easily separable fasteners are hook and loop fasteners.

3. The assemblage of claim 1 wherein said covering is comprised of a single panel.

4. The assemblage of claim 1 wherein said covering is comprised of a right front panel, left front panel, and back panel, said right front panel being removably attached to said back panel at said right hip by an easily separable fastener, and said left front panel being removably attached to said back panel at said left hip by an easily separable fastener.

5. The assemblage of claim 4 wherein said easily separable fasteners are hook and loop fasteners.

6. The assemblage of claim 1 wherein said front closure has a flap, and said right front portion and said left front portion are removably attached to said turnout coat adjacent to said flap.

7. The assemblage of claim 1 wherein said front closure has a flap with an edge, and one of said front portions is removably attached to said turnout coat adjacent to said flap and the other of said front portions is removably attached to said turnout coat at said flap edge.

* * * * *